US005929352A

United States Patent [19]

Gutc, Jr. et al.

[11] Patent Number: 5,929,352

[45] Date of Patent: Jul. 27, 1999

[54] HARMONICA HOLDING DEVICE

[76] Inventors: Frank Gutc, Jr.; Ann Gutc, both of 48654 Rex, Utica, Mich. 48317

[21] Appl. No.: 09/057,757

[22] Filed: Apr. 9, 1998

[51] Int. Cl.[6] ..... G10D 7/12

[52] U.S. Cl. ..... 84/379; 84/378; 84/DIG. 14

[58] Field of Search ..... 84/377, 378, 379, 84/DIG. 14

[56] References Cited

U.S. PATENT DOCUMENTS 4,287,803 9/1981 Zema ..... 84/1.06
5,479,481 12/1995 Garrett ..... 84/379
5,619,001 4/1997 Pasin et al. ..... 84/379

*Primary Examiner*—William M. Shoop, Jr.
*Assistant Examiner*—Marlon T. Fletcher

[57] ABSTRACT

A new harmonica holding device for holding a plurality of harmonicas on a user. The inventive device includes a neck member having an arcuate portion and a pair of spaced apart elongate arms extending from the arcuate portion. Extending from the terminal end of each arm of the neck members is a rod. Mounted to each one of the rods is a mount member having a center and a plurality of spokes radially extending outwards the from the center. Each of the spokes of each mount member has a clip member which is adapted for holding an end of a harmonica.

9 Claims, 2 Drawing Sheets

10
18
20
23
3
23
24
4
4
14
24
1
1
1
28
13
24
24
15
23
24
21
12
23
19
27

21
23
10
1
19
27
12
17
29
13
15

HARMONICA HOLDING DEVICE

BACKGROUND OF THE INVENTION

1. Field of the Invention

The present invention relates to harmonica holding devices and more particularly pertains to a new harmonica holding device for holding a plurality of harmonicas on a user.

2. Description of the Prior Art

The use of harmonica holding devices is known in the prior art. More specifically, harmonica holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art harmonica holding devices include U.S. Pat. No. 5,104,081; U.S. Pat. No. 4,287,803; U.S. Pat. No. 4,739,686; U.S. Pat. No. 4,402,249; U.S. Pat. No. Des. 279,905; and U.S. Pat. No. 4,212,219.

While these devices fulfill their respective, particular objectives and requirements, the aforementioned patents do not disclose a new harmonica holding device. The inventive device includes a neck member having an arcuate portion and a pair of spaced apart elongate arms extending from the arcuate portion. Extending from the terminal end of each arm of the neck members is a rod. Mounted to each one of the rods is a mount member having a center and a plurality of spokes radially extending outwards the from the center. Each of the spokes of each mount member has a clip member which is adapted for holding an end of a harmonica.

In these respects, the harmonica holding device according to the present invention substantially departs from the conventional concepts and designs of the prior art, and in so doing provides an apparatus primarily developed for the purpose of holding a plurality of harmonicas on a user.

SUMMARY OF THE INVENTION

In view of the foregoing disadvantages inherent in the known types of harmonica holding devices now present in the prior art, the present invention provides a new harmonica holding device construction wherein the same can be utilized for holding a plurality of harmonicas on a user.

The general purpose of the present invention, which will be described subsequently in greater detail, is to provide a new harmonica holding device apparatus and method which has many of the advantages of the harmonica holding devices mentioned heretofore and many novel features that result in a new harmonica holding device which is not anticipated, rendered obvious, suggested, or even implied by any of the prior art harmonica holding devices, either alone or in any combination thereof.

To attain this, the present invention generally comprises a neck member having an arcuate portion and a pair of spaced apart elongate arms extending from the arcuate portion. Extending from the terminal end of each arm of the neck members is a rod. Mounted to each one of the rods is a mount member having a center and a plurality of spokes radially extending outwards the from the center. Each of the spokes of each mount member has a clip member which is adapted for holding an end of a harmonica.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new harmonica holding device apparatus and method which has many of the advantages of the harmonica holding devices mentioned heretofore and many novel features that result in a new harmonica holding device which is not anticipated, rendered obvious, suggested, or even implied by any of the prior art harmonica holding devices, either alone or in any combination thereof.

It is another object of the present invention to provide a new harmonica holding device which may be easily and efficiently manufactured and marketed.

It is a further object of the present invention to provide a new harmonica holding device which is of a durable and reliable construction.

An even further object of the present invention is to provide a new harmonica holding device which is susceptible of a low cost of manufacture with regard to both materials and labor, and which accordingly is then susceptible of low prices of sale to the consuming public, thereby making such harmonica holding device economically available to the buying public.

Still yet another object of the present invention is to provide a new harmonica holding device which provides in the apparatuses and methods of the prior art some of the advantages thereof, while simultaneously overcoming some of the disadvantages normally associated therewith.

Still another object of the present invention is to provide a new harmonica holding device for holding a plurality of harmonicas on a user.

Yet another object of the present invention is to provide a new harmonica holding device which includes a neck member having an arcuate portion and a pair of spaced apart elongate arms extending from the arcuate portion. Extending from the terminal end of each arm of the neck members is a rod. Mounted to each one of the rods is a mount member having a center and a plurality of spokes radially extending outwards the from the center. Each of the spokes of each mount member has a clip member which is adapted for holding an end of a harmonica.

Still yet another object of the present invention is to provide a new harmonica holding device that allows a user the ability to play from a selection of harmonicas generally hands free.

Even still another object of the present invention is to provide a new harmonica holding device that allows a user to change between harmonicas while playing another instrument.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
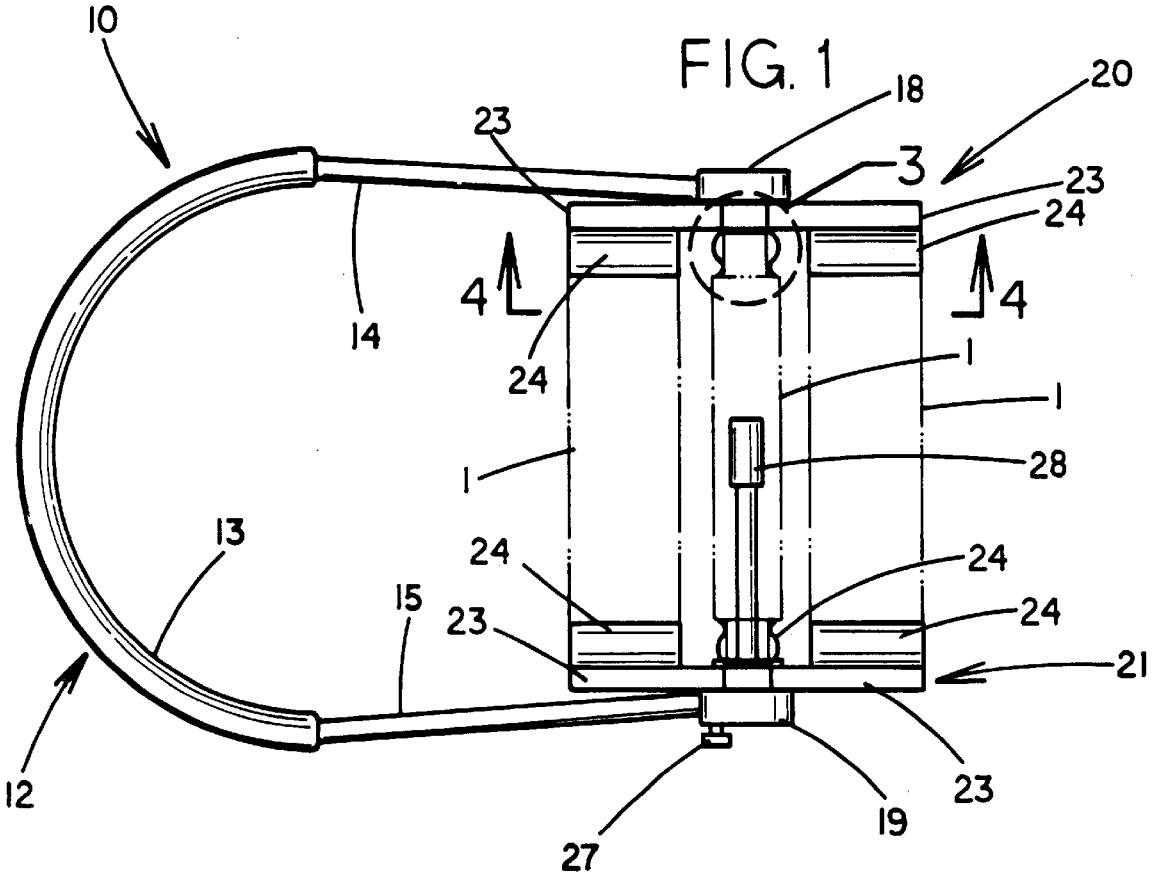
FIG. 1 is a schematic top side view of a new harmonica holding device according to the present invention.
Figure 2:
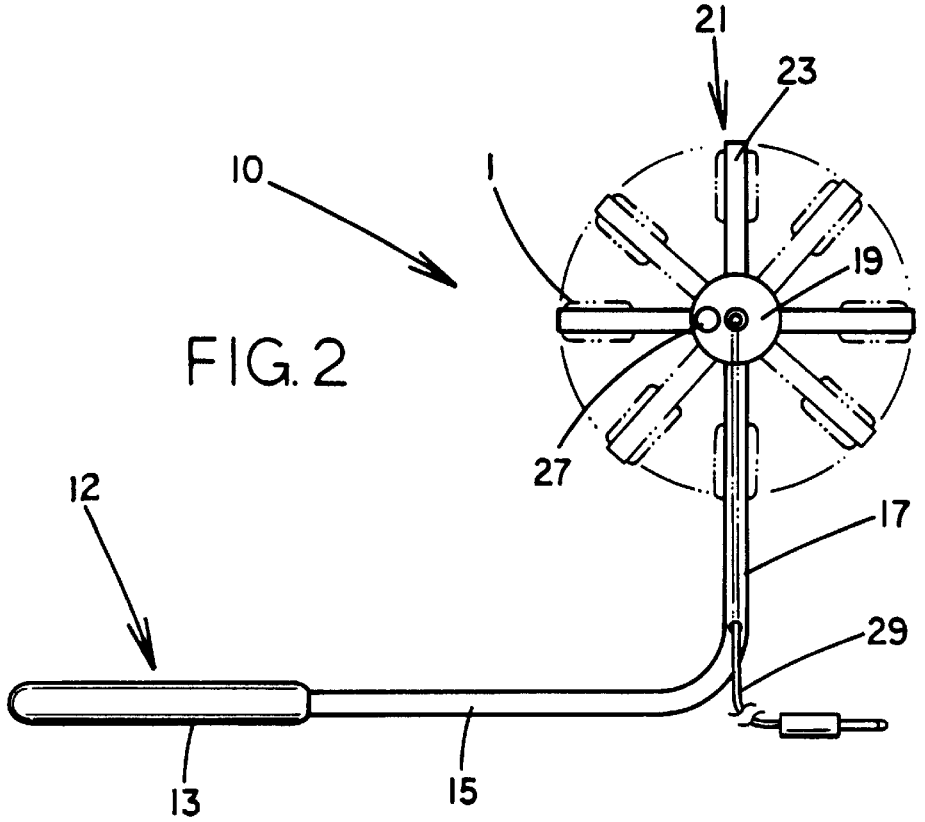
FIG. 2 is a schematic side view of the present invention.
Figure 3:
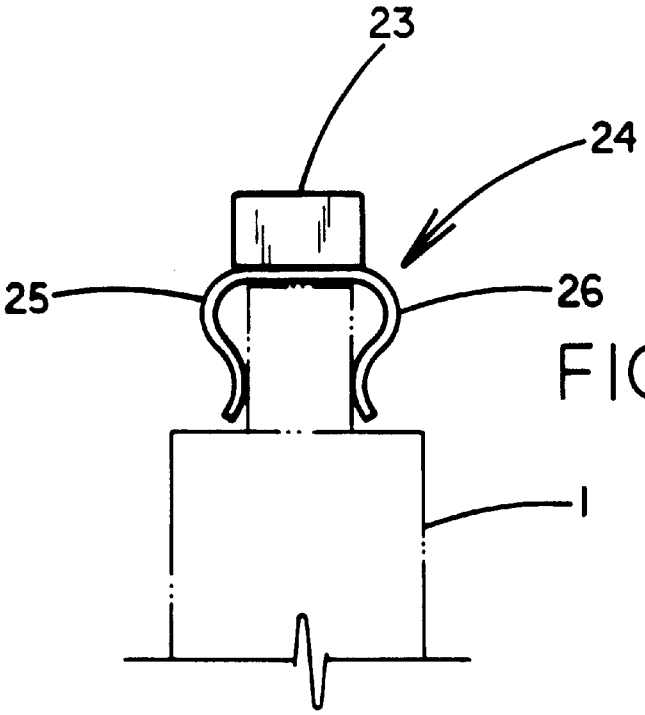
FIG. 3 is a schematic partial side view of the present invention taken from the circle 3 of FIG. 1.
Figure 4:
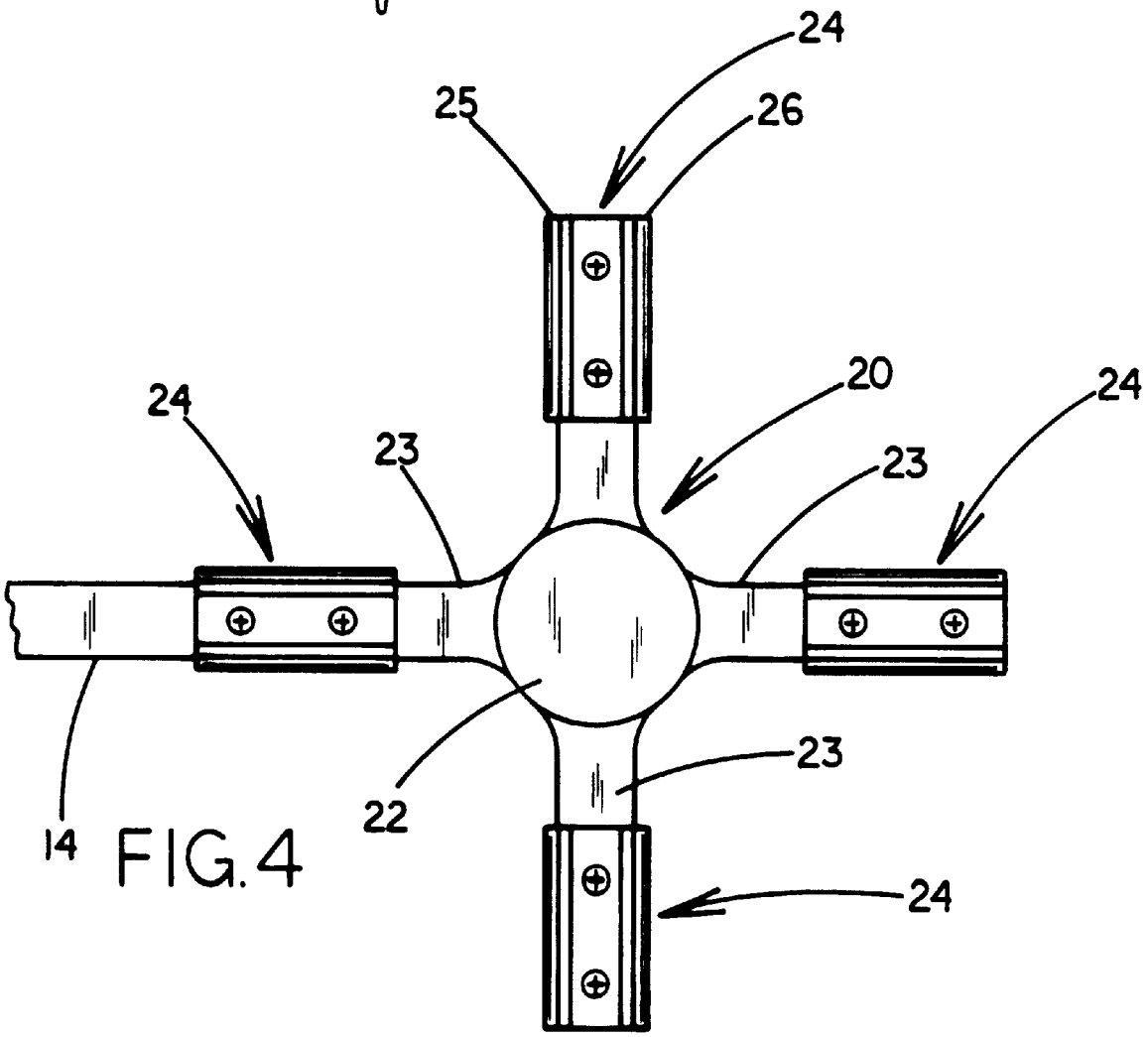
FIG. 4 is a schematic partial side view of the present invention taken from line 4—4 of FIG. 1.

With reference now to the drawings, and in particular to FIGS. 1 through 4 thereof, a new harmonica holding device embodying the principles and concepts of the present invention and generally designated by the reference numeral 10 will be described.

As best illustrated in FIGS. 1 through 4, the harmonica holding device 10 generally comprises a neck member 12 having an arcuate portion 13 and a pair of spaced apart elongate arms 14,15 extending from the arcuate portion 13. Extending from the terminal end of each arm 14,15 of the neck member 12 is a rod. Mounted to each one of the rods 16,17 is a mount member 20,21 having a center 22 and a plurality of spokes 23 radially extending outwards the from the center 22. Each of the spokes 23 of each mount member 20,21 has a clip member 24 which is adapted for holding an end of a harmonica 1.

The holding device 10 is designed for holding several harmonicas 1 to a user so that the user can easily play one of the harmonicas and easily change between harmonicas. Specifically, the neck member 12 is generally U-shaped and has an arcuate portion 13 and a pair of spaced apart elongate arms 14,15 which extend from the arcuate portion 13. Each of the arms 14,15 of the neck member 12 ends at a terminal end. The neck member 12 is designed for looping around the neck of a user such that the arcuate portion 13 rest on the back of the neck of the user while the arms 14,15 of the neck member 12 extend outwards in front of the user. Ideally, the terminal ends of the arms 14,15 are extended towards one another such that the space between the arms 14,15 of the neck member 12 tapers towards the terminal ends of the arms 14,15. Optionally, the arcuate portion 13 of the neck member 12 may be constructed from a flexible material, such as a rubber, for comfort and stability. In another optional embodiment, the length of the arcuate portion 13 of the neck member 12 may be adjustably extendible to fit around variously sized necks.

The device 10 also includes a pair of elongate rods 16,17, with one of the rods 16 extending from the terminal end of one of the arms 14 of the neck member 12 and the other rod 17 is extended from the terminal end of another of the arms 15 of the neck member 12. Preferably, each of the rods 16,17 has a rotation mount at their upper free end 18,19.

Rotatively mounted to each of the free ends 18,19 of the rods 16,17 is a mount member 20,21. Each mount member 20,21 has a center 22 and a plurality of spokes 23 which extend radially outwards the from the center 22 of its respective mount member 20,21. One of the mount members 20 is rotatively mounted to the free end 18 of one of the rods 16 to permit free rotation of the mount member 20 about its center 22 while the other mount member 21 is similarly mounted to its associated rod 16.

Each spoke 23 of each of the mount members 20,21 has a clip member 24 attached thereto which is located preferably towards their respective free outer ends. Each clip member 24 is adapted for holding an end of a harmonica 1 which is extended in the space between the mount members 20,21, Preferably, each of the spokes 23 of the first mount member 20 is associated with a corresponding spoke 23 of the second mount member 21 such that the associated spokes are generally coplanar with one another when a harmonica 1 is attached to them. Ideally, each clip member 24 has a pair of spaced apart clip arms 14,15 that are adapted to hold the end of a harmonica 1 between them such that a harmonica 1 is extended between a pair of associated spokes 23 extends generally perpendicular to the lengths of the associated spokes 23. Preferably, each of the clip arms 14,15 is generally S-shaped.

In a preferred embodiment, the holding device further includes a microphone 28 which is extended from the center of one of the mount members 20,21 into the space between the first and second mount members 20,21. The microphone 28 is preferably electrically couplable to an amplification device by a cord 29 that preferably extends through the associated rod of the mount member. In the preferred embodiment, the free end 19 of one of the rods 17 also has a locking pin 27 for locking the associated mount member 21 against rotation with respect to its rod 1 to hold the mount member in a position so that a harmonica 1 held by the spokes 23 may be positioned near the mount of a user so that it may be played.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A holding device for harmonicas, comprising:

a neck member being generally U-shaped and having an arcuate portion and a pair of spaced apart elongate arms being extended from said arcuate portion of said neck member, each of said arms of said neck member having a terminal end;

a pair of elongate rods, one of said rods being extended from the terminal end of one of said arms of said neck member, another of said rods being extended from the terminal end of another of said arms of said neck member, each of said rods having a free end;

first and second mount members, each said mount member having a center and a plurality of spokes, said spokes of each of said mount members being radially extended outwards said from the center of its respective mount member, said first mount member being rotatively mounted to the free end of one of said rods, said second mount member being rotatively mounted to the free end of another of said rods, each of said spokes of said first mount member being associated with a corresponding spoke of said second mount member; and each of said spoke of each of said mount member having a clip member, each clip member being adapted for holding an end of a harmonica.

2. The device of claim 1, wherein said terminal ends of said arms of said neck member are extended towards one another such that the space between said arms of said neck member tapers towards said terminal ends of said arms of said neck member.

3. The device of claim 1, wherein said arcuate portion of said neck member comprises a flexible material.

4. The device of claim 1, wherein the length of said arcuate portion of said neck member is adjustably extendible.

5. The device of claim 1, wherein each clip member has a pair of spaced apart clip arms, each of said pair clip arms being adapted to hold the end of a harmonica therebetween such that a harmonica being extended between a pair of associated spokes extends generally perpendicular to the lengths of the associated spokes.

6. The device of claim 5, wherein each of said clip arms is generally S-shaped.

7. The device of claim 1, further comprising a microphone being extended from the center of one of said mount members into the space between said first and second mount members.

8. The device of claim 1, wherein said free end of one of said rods having a locking pin for locking the associated mount member of said rod against rotation.

9. A holding device for harmonicas, comprising:

a neck member being generally U-shaped and having an arcuate portion and a pair of spaced apart elongate arms being extended from said arcuate portion of said neck member, each of said arms of said neck member having a terminal end, wherein said terminal ends of said arms of said neck member are extended towards one another such that the space between said arms of said neck member tapers towards said terminal ends of said arms of said neck member, wherein said arcuate portion of said neck member comprises a flexible material, wherein the length of said arcuate portion of said neck member is adjustably extendible;

a pair of elongate rods, one of said rods being extended from the terminal end of one of said arms of said neck member, another of said rods being extended from the terminal end of another of said arms of said neck member, each of said rods having a free end;

first and second mount members, each said mount member having a center and a plurality of spokes, said spokes of each of said mount members being radially extended outwards said from the center of its respective mount member, said first mount member being rotatively mounted to the free end of one of said rods, said second mount member being rotatively mounted to the free end of another of said rods, each of said spokes of said first mount member being associated with a corresponding spoke of said second mount member;

each of said spoke of each of said mount member having a clip member, each clip member being adapted for holding an end of a harmonica, wherein each clip member has a pair of spaced apart clip arms, each of said pair clip arms being adapted to hold the end of a harmonica therebetween such that a harmonica being extended between a pair of associated spokes extends generally perpendicular to the lengths of the associated spokes, each of said clip arms being generally S-shaped;

a microphone being extended from the center of one of said mount members into the space between said first and second mount members; and said free end of one of said rods having a locking pin for locking the associated mount member of said rod against rotation.

* * * * *